US005155017A

United States Patent [19]

Sato et al.

[11] Patent Number: 5,155,017

[45] Date of Patent: Oct. 13, 1992

[54] SILVER HALIDE PHOTOGRAPHIC MATERIAL

[75] Inventors: Minoru Sato; Shigeharu Urabe, both of Kanagawa, Japan

[73] Assignee: Fuji Photo Film Co., Ltd., Kanagawa, Japan

[21] Appl. No.: 728,819

[22] Filed: Jul. 5, 1991

Related U.S. Application Data

[62] Division of Ser. No. 462,368, Jan. 9, 1990, abandoned.

[30] Foreign Application Priority Data

Jan. 9, 1989 [JP] Japan ..... 1-2466

[51] Int. Cl.[5] ..... G03C 1/005

[52] U.S. Cl. ..... 430/569; 430/567

[58] Field of Search ..... 430/567, 569

[56] References Cited

U.S. PATENT DOCUMENTS

| | | | |
|---|---|---|---|
| 3,206,313 | 9/1965 | Porter et al. | 430/567 |
| 3,317,322 | 5/1967 | Porter et al. | 430/567 |
| 3,790,386 | 2/1974 | Posse et al. | 430/642 |
| 3,935,014 | 1/1976 | Klotzer et al. | 430/567 |
| 3,957,488 | 5/1976 | Klotzer et al. | 430/567 |
| 4,434,226 | 2/1984 | Wilgus et al. | 430/567 |
| 4,495,277 | 1/1985 | Becker et al. | 430/567 |
| 4,581,327 | 4/1986 | Habu et al. | 430/567 |
| 4,623,612 | 11/1986 | Nishikawa et al. | 430/567 |
| 4,879,208 | 11/1989 | Urabe | 430/569 |
| 4,904,580 | 2/1990 | Komatsu et al. | 430/569 |
| 4,917,991 | 4/1990 | Tosaka et al. | 430/567 |
| 4,977,075 | 12/1990 | Ihama et al. | 430/567 |
| 5,004,679 | 4/1991 | Mifune et al. | 430/569 |
| 5,035,991 | 7/1991 | Ichikawa et al. | 430/567 |

FOREIGN PATENT DOCUMENTS 1472745 3/1979 Fed. Rep. of Germany .

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide photographic material, which comprises a support having thereon at least one silver halide emulsion layer, the silver halide emulsion layer containing light-sensitive silver halide grains having a structure such that cores of the respective grains have a completely uniform halide distribution and that shells with a higher silver chloride content than the cores are deposited outside the cores with no projections.

10 Claims, 2 Drawing Sheets

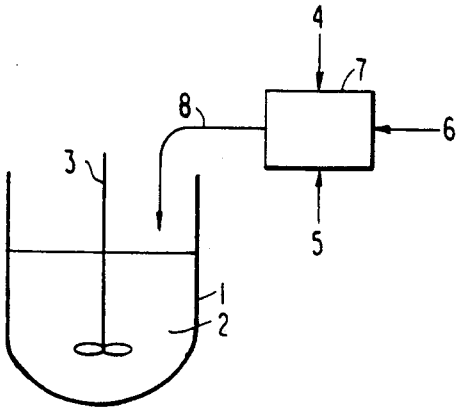
FIG.1
FIG.4
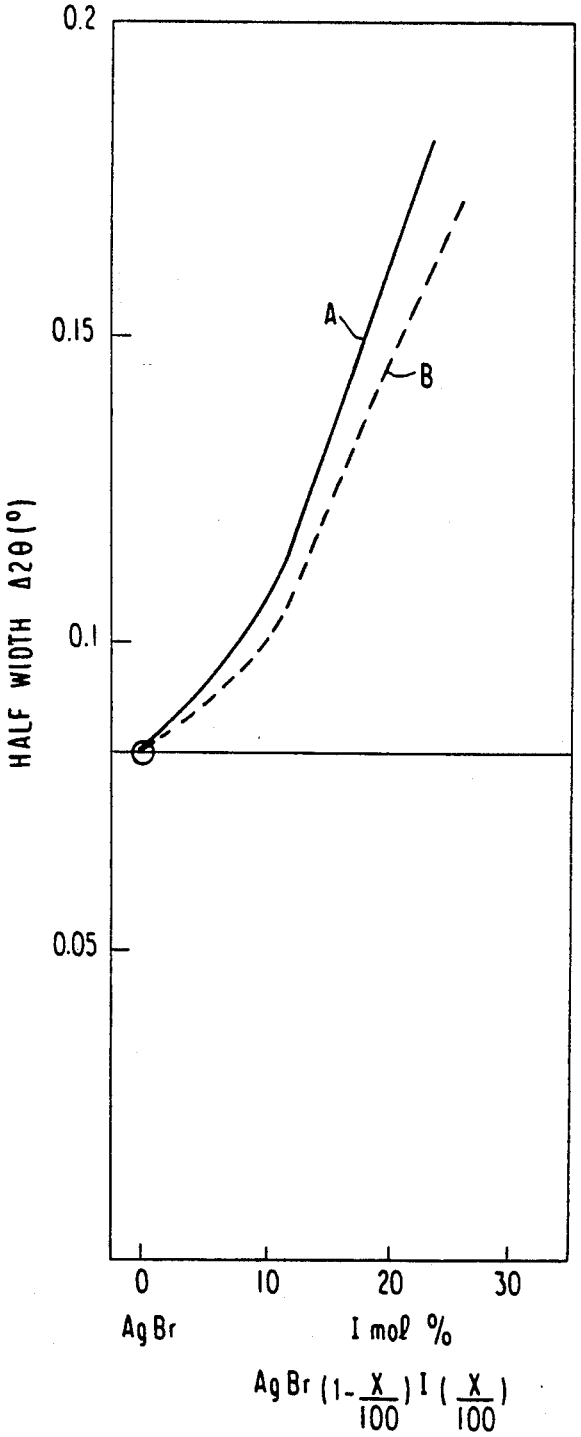
FIG.2
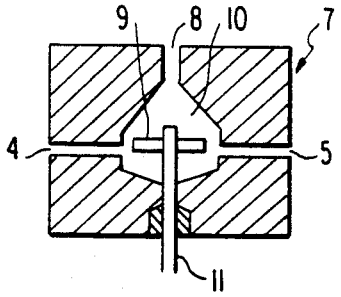

SILVER HALIDE PHOTOGRAPHIC MATERIAL

This is a Rule 62 Divisional of application Ser. No. 07/462,368 filed Jan. 9, 1990, now abandoned.

FIELD OF THE INVENTION

This invention relates to a silver halide photographic material using an emulsion having high speed and improved preservability and production stability.

BACKGROUND OF THE INVENTION

Format size reduction of silver halide light-sensitive materials has recently advanced so much that photographic light-sensitive materials with more sensitivity and better image quality have been eagerly desired.

This desire leads to an even greater demand for photographic silver halide emulsions with still higher-level photographic properties, such as, much higher sensitivity, much higher contrast, and much better graininess and sharpness.

In order to comply with this demand, processes for producing and techniques of using tabular grains to improve sensitivity by improving the color sensitizing efficiency by sensitizing dyes, improving the relationship between sensitivity and graininess, and improving sharpness and covering power are disclosed in U.S. Pat. Nos. 4,386,156, 4,504,570, 4,478,929, 4,414,304, 4,411,986, 4,400,463, 4,414,306, 4,439,520, 4,433,048, 4,434,226, 4,413,053, 4,459,353, 4,490,458 and 4,399,215.

Techniques for improving the sensitivity of tabular grains with a specific shape are disclosed in U.S. Pat. Nos. 4,435,501 and 4,459,353 while disclose tabular grains formed by epitaxially depositing silver chloride guest grains as projections onto host tabular grains at selected surface sites.

On the other hand, epitaxial deposition of silver chloride guest grains onto host grains is disclosed in Berry and Skillman, "Surface Structures and Epitaxial Growths on AgBr Microcrystals", *Journal of Applied Physics*, Vol. 35, No. 7, July 1964, PP. 2165–2969.

U.S. Pat. Nos. 3,804,629 discloses that the stability of a silver halide emulsion to metal dust is improved by depositing silver chloride onto silver halide grains prior to chemical ripening of the silver halide emulsion after physical ripening and desalting of the emulsion. In this deposition, the silver chloride forms small projections on the silver halide host grains.

U.K. Patent 2,038,792A discloses a technique for selectively depositing silver chloride onto the corners of silver bromide tetradecahedral grains.

U.S. Pat. Nos. 3,505,068, 4,094,684 and 4,142,900 disclose a technique for epitaxially depositing silver chloride onto silver iodide host grains.

However, grains where silver chloride is epitaxially deposited onto host grains, or grains with projections on their surfaces, are thermodynamically so unstable that the grain shape changes when stored at an elevated temperature or when stored for a long period of time and inevitably a deterioration of sensitivity and an increase of fog occur, thus being unfavorable as silver halide emulsion-production methods.

In addition, with light-sensitive layers of a multi-layer structure having two or more emulsion layers, one emulsion layer is influenced by the other emulsion layer or layers. For example, one emulsion layer is influenced by diffusion of halide ion or the like from other emulsion layers upon coating of emulsion layers. As a result, grains with projections on their surfaces easily undergo a change in grain shape. Thus, it is difficult to provide the performance obtained by coating a single layer. Emulsions of grains with projections also have problems as to storage stability due to emulsion layer-to-emulsion layer migration of dyes, antifoggants, etc. depending upon the storage conditions such as storage temperature, storage humidity and storage period.

Further, silver halide grains with silver chloride epitaxially deposited thereon to often suffer a deterioration in graininess although sensitivity is improved. That is, this sensitizing technique is not necessarily a sufficient technique from the standpoint of the sensitivity/graininess of silver halide grains.

On the other hand, AgCl-shell grains are described in *Berichte der Bunzen Gesellschaft fur Physikalische Chemie*, 67, 356 (1963), U.K. Patent 1,027,146, etc.

However, the grains described in *Berichte der Bunzen Gesellschaft fur Physikalische Chemie*, 67, 356 (1963) are grains of cubic AgBr cores with a shell of 100-Å AgCl, and the grains disclosed in the Examples of U.K. Patent 1,027,146 are grains with a thick AgCl shell which are not intended to be processed with an ordinary developer. Grains covered by the AgCl shell in a thickness as thick as described above have deteriorated graininess and concurrently dye adsorption is deteriorated.

JP-A-1-121848 and JP-A-1-26839 etc. (the term "JP-A" as used herein means an "unexamined published Japanese patent application") describe silver halide photographic emulsions containing silver bromide series grains which have no projections on the surface thereof and wherein silver chloride content of the surface silver halide layer is higher than that of the portion inside the surface.

However, the silver halide grains described therein, which structurally comprise silver halide layer-forming base grains on the inside with a silver chloride layer forming a silver halide layer on the grain surface, are not particularly limited as to the technique of forming the base silver halide layer inside the grains.

In general, silver halide grains are formed by reacting an aqueous solution of a silver salt with an aqueous solution of a halide in an aqueous colloidal solution in a reaction vessel. The single jet process which comprises adding an aqueous solution of a silver salt to a mixture of a protective colloid such as gelatin and an aqueous solution of a halide in a reaction vessel with stirring over a certain period of time and the double jet process which comprises adding an aqueous solution of a halide and an aqueous solution of a silver salt to an aqueous solution of gelatin in a reaction vessel for certain periods of time, respectively. By comparison, the double jet process provides silver halide grains having a narrower grain size distribution than the single jet process. In the double jet process, the halide composition ca be freely altered as the growth of the grains progresses.

It is known that the growth rate of silver halide grains largely depends on the concentration of silver ions (halogen ions) in the reaction solution, the concentration of the silver halide solvent, the distance between the grains, the grain size, etc. In particular, the lack of uniformity in the concentration of silver ions or halogen ions produced by the addition of an aqueous solution of a silver salt and an aqueous solution of a halide results in different growth rates, giving a non-uniformity in the resulting silver halide emulsion. In order to eliminate this problem, it is necessary to rapidly and uniformly mix and react the aqueous solution of the silver salt with the aqueous solution of the halide in the aqueous solution of the colloid so as to provide uniformity in the concentration of the silver ions or the halogen ions in the reaction vessel. In the conventional process which comprises adding an aqueous solution of a halide and an aqueous solution of a silver salt to the surface of an aqueous solution of a colloid in a reaction vessel, portions of higher halogen ion and silver ion concentrations are produced in the vicinity of the location at which each reaction solution is added. This results in difficulty in the preparation of uniform silver halide grains. Methods for eliminating such an uneven concentration distribution are disclosed in U.S. Pat. No. 3,415,650, and 3,692,283,and U.K. Patent 1,323,464. In these methods, a reaction vessel is filled with an aqueous solution of a colloid. The reaction vessel is equipped with a rotary convex cylindrical hollow mixer having slits in the wall thereof (filled with an aqueous solution of a colloid, preferably composed of an upper chamber and a lower chamber partitioned by a disc in the vessel). The axis of rotation of the mixer is vertical. The aqueous solution of the halide and the aqueous solution of the silver salt are supplied into the mixer, which is rotating at a high speed, at the top and bottom open ends through feed pipes so that they are rapidly mixed and reacted with each other. (If there are two chambers in the mixer, the two aqueous solutions supplied into the respective chamber are first diluted with an aqueous solution of the colloid present therein, and then they are rapidly mixed and reacted with each other in the vicinity of the outlet slits.) The silver halide grains thus formed are then introduced into the aqueous solution of the colloid in the reaction vessel by the centrifugal force produced by the rotation of the mixer.

On the other hand, U.S. Pat. No. 4,289,733 discloses a method for eliminating an uneven concentration distribution to prevent non-uniform growth of grains. In this method, an aqueous solution of a halide and an aqueous solution of a silver salt are separately supplied into a mixer filled with an aqueous solution of the colloid in a reaction vessel filled with an aqueous solution of the colloid from the bottom open end of the mixer through feed pipes. These reaction solutions are rapidly agitated and mixed with each other by a lower agitator (turbine impeller) provided in the mixer to effect the growth of silver halide. The resulting silver halide grains are immediately introduced into the aqueous solution of the colloid in the reaction vessel from the upper open end of the mixer by an upper agitator provided above the lower agitator.

JP-A-57-92523 discloses a preparation method which is intended to eliminate such a non-uniformity in concentration. In this method, an aqueous solution of a halide and an aqueous, solution of a silver salt are separately supplied into a mixer filled with an aqueous solution of a colloid in a reaction vessel filled with an aqueous solution of the colloid from a lower open end of the mixer. The two reaction solutions are diluted with the aqueous solution of the colloid and then rapidly mixed with each other by a lower agitator provided in the mixer. The resulting silver halide grains are immediately introduced into the aqueous solution of the colloid in the reaction vessel from an upper open end of the mixer. In this method and apparatus therefor, the two reaction solutions which have been diluted with the aqueous solution of the colloid are passed through the clearance between the inner wall of the mixer and the tip of the agitator without being passed through the gap between the impellers so that they are rapidly mixed and reacted with each other under a shearing force in the clearance to form silver halide grains.

These methods and apparatus can thoroughly eliminate the uneven distribution of concentration of silver ions and halogen ion in the reaction vessel. However, an uneven concentration distribution still exists in the mixer. In particular, a relatively large uneven concentration distribution exists in the vicinity of the nozzle through which the aqueous solution of the silver salt and the aqueous solution of the halide are supplied of the portion under the agitator and of the portions agitated. Furthermore, the silver halide grains supplied into the mixer together with the protective colloid are passed through these portions having an uneven concentration distribution. It should be particularly noted that the silver halide grains rapidly grow in these portions. In other words, these preparation methods and apparatus therefor are disadvantageous in that an uneven concentration distribution exists in the mixer, and the growth of grains takes place rapidly in the mixer, failing to accomplish the object of allowing uniform growth of the silver halide under conditions free of a concentration distribution difference.

In order to accomplish a more efficient mixing so as to eliminate the uneven concentration distribution of silver ions and halogen ions, additional attempts have been made. For example, a reaction vessel and a mixer are independently provided. An aqueous solution of a silver salt and an aqueous solution of a halide are supplied into the mixer where they are rapidly mixed with each other to effect the growth of silver halide grains. In a preparation method and apparatus disclosed in U.K. Patents 1,591,608 and 1,243,356 an aqueous solution of a protective colloid (containing silver halide grains) is pumped from the bottom of a reaction vessel and circulated therein. A mixer is provided in the course of the circulation system. An aqueous solution of a silver salt and an aqueous solution of a halogen are supplied into the mixer where they are rapidly mixed with each other to effect the growth of silver halide grains. In a method disclosed in U.S. Pat. No. 3,897,935, an aqueous solution of a protective colloid (containing silver halide grains) is pumped from the bottom of a reaction vessel and circulated therein. An aqueous solution of a halide and an aqueous solution of a silver salt are pumped into the course of the circulation system. In a preparation method and apparatus disclosed in JP-A-53-47397, an aqueous solution of a protective colloid (containing silver halide grains) is pumped from the bottom of a reaction vessel and circulated therein. An aqueous solution of an alkali metal halide is first introduced into the circulation system. The aqueous solution of an alkali metal halide is diffused into the system until the system becomes uniform. Thereafter, an aqueous solution of a silver salt is introduced into and mixed with the system to form silver halide grains. These methods enable independent altering of the rate at which the aqueous solutions flow from the reaction vessel to the circulation system and the agitation efficiency of the mixer, making it possible to effect growth of grains under a condition of a more uniform concentration distribution. However, these methods are still disadvantageous in that the crystalline silver halide which has been delivered from the reaction vessel together with the protective colloid is subject to rapid growth at the inlet portion from which the aqueous solution of the silver salt and the aqueous solution of the halide are introduced into the system. Therefore, in these methods, it is impossible, in principle, to eliminate such a concentration distribution difference in the mixing portion or in the vicinity of the inlet portion. That is, the object of allowing uniform growth of silver halide under a condition free of concentration distribution cannot be accomplished.

As has been described hereinabove, in forming the silver halide layer to be used as a base layer as described in JP-A-1-121848 and JP-A-1-26839, it is impossible to grow the base silver halide layer uniformly in the absence of a concentration gradation of silver and halide ions by employing conventionally known processes for forming silver halide grains.

SUMMARY OF THE INVENTION

An object of the present invention is to provide a high-speed light-sensitive material using an emulsion of silver halide grains having improved preservability and production stability.

Another object of the present invention is to provide a light-sensitive material using an emulsion of high-speed silver halide grains without a deterioration in graininess.

A further object of the present invention is to provide a light-sensitive material using a silver halide emulsion where an improvement in sensitivity involving improvement of color-sensitizing efficiency by sensitizing dyes, improvement in the relationship between sensitivity and graininess, improvement of sharpness and improvement of covering power is successfully achieved.

Still a further object of the present invention is to provide a light-sensitive material containing an emulsion of silver halide grains having improved preservability.

Yet, a further object of the present invention is to provide a photographic light-sensitive material having excellent sensitivity/graininess, sharpness and preservability.

These and other objects of the present invention will become apparent from the following description thereof.

The above-described and other objects of the present invention are attained by the following embodiments (1), (2) or (3) of the present invention.

(1) A silver halide photographic material, which comprises a support having thereon at least one silver halide emulsion layer, this silver halide emulsion layer containing light-sensitive silver halide grains having a structure such that the cores of the silver halide grains have a completely uniform halide distribution and such that shells with a higher silver chloride content than the cores are deposited outside the cores with no projections.

(2) A silver halide photographic material as in embodiment (1), wherein the silver halide emulsion layer is obtained by adding a previously prepared silver halide emulsion containing fine-sized silver halide particles to a reaction vessel in which nuclei formation and/or crystal growth occurs, then conducting nuclei formation and/or crystal growth in the reaction vessel to prepare silver halide grains, and depositing silver halide with a higher silver chloride content than that present in the above-prepared silver halide grains (cores) on the outside of the cores with no projections being formed.

(3) A silver halide photographic material as in embodiment (2), wherein light-sensitive silver halide grains in the silver halide emulsion layer are obtained by supplying an aqueous solution of a water-soluble silver salt and an aqueous solution of a water-soluble halide salt into a mixer provided outside the reaction vessel, and mixing the solutions in the mixer to form silver halide fine particles, immediately feeding the fine particles to a reaction vessel, conducting nuclei formation and/or crystal growth to obtain silver halide (core) grains, then depositing silver halide with a higher silver chloride content than that of the above-prepared silver halide grains (cores) on the outside of the cores with no projections being formed.

BRIEF DESCRIPTION OF THE DRAWINGS

FIG. 1 is a schematic view of the process of the present invention wherein: 1 is a reaction vessel; 2 is a protective colloid aqueous solution; 3 is a propeller; 4 is a halide salt aqueous solution-addition system; 5 is a silver salt aqueous solution-addition system; 6 is a protective colloid-adding system; and 7 is a mixer.

FIG. 2 is a detailed view of the mixer in accordance with the present invention wherein: 4, 5 and 7 are the same as defined in FIG. 1; 8 is a system for introduction into reaction vessel; 9 is an agitator; 10 is a reaction chamber; and 11 is a rotary shaft.

FIGS. 3 and 4 provide X-ray diffraction data showing the uniformity of silver halide grains, with the half-width of X-ray diffraction profile as the ordinate and the halide composition of the silver halide grains as the abscissa.

DETAILED DESCRIPTION OF THE INVENTION

Figure 3:
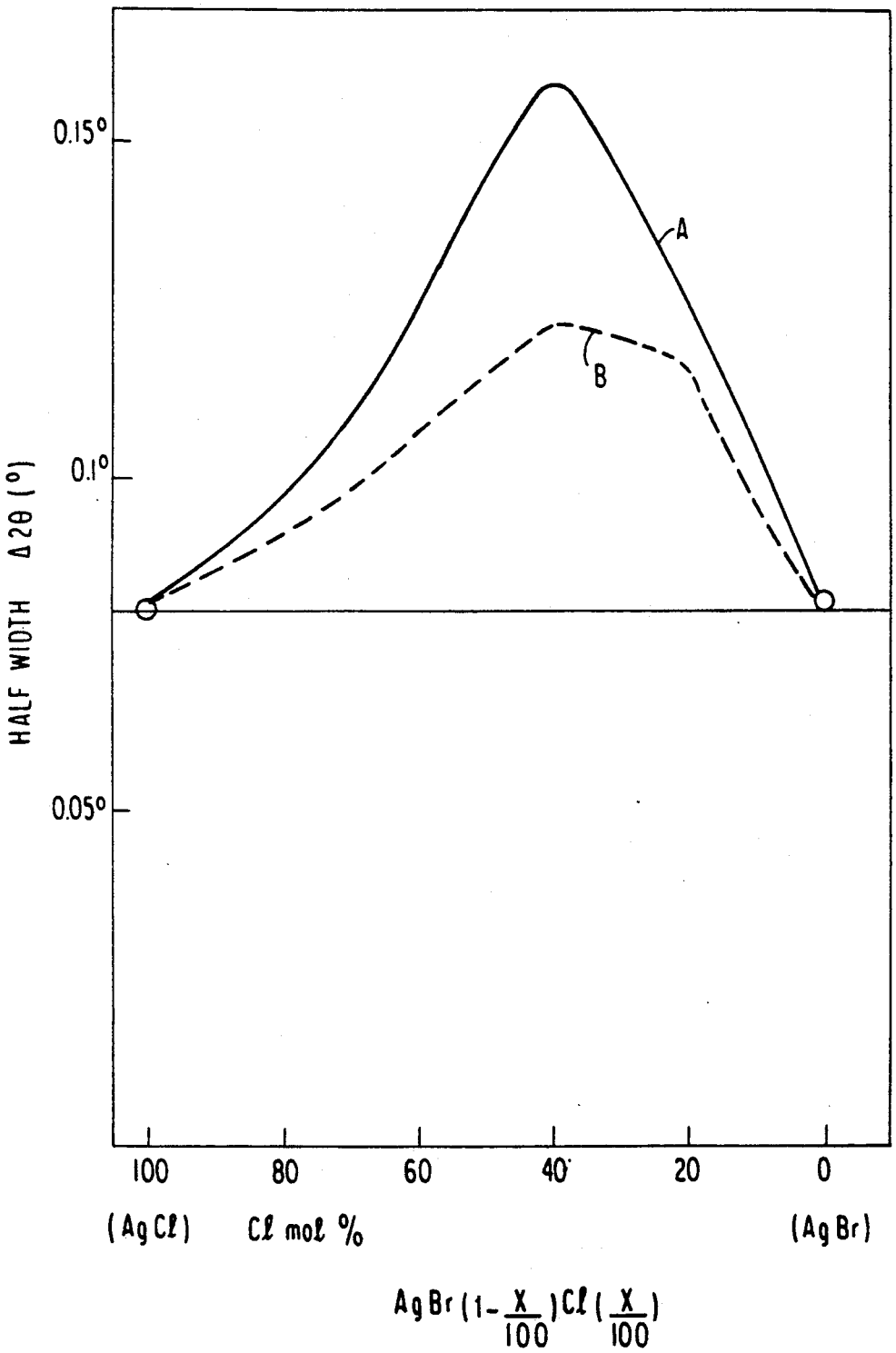

The silver halide grains of the present invention structurally comprise core grains forming a base silver halide layer inside the grains and a silver chloride-containing layer which forms a silver halide layer on the grain surface. The present invention is characterized in a process for forming the silver halide layer within the grains and in that the silver chloride-containing layer forming the silver halide layer on the grain surface is extremely thin in thickness.

In order to conduct uniform nuclei formation and/or grain growth in the absence of concentration gradation of silver ion and/or halide ion to thereby form the base silver halide layer within the grains (core), the following processes (A) and (B) can be employed.

Process (A):

A mixer is provided outside a reaction vessel in which nuclei formation and/or crystal growth of silver halide grains occurs and which contains a protective colloid aqueous solution; an aqueous solution of a water-soluble silver salt, an aqueous solution of a water-soluble halide salt, and a protective colloid aqueous solution are fed into the mixer for mixing; then the resulting mixture is immediately fed into the reaction vessel for crystal growth of the silver halide grains in the reaction vessel.

A specific system is shown in FIG. 1.

In FIG. 1, a reaction vessel 1 contains an aqueous solution of protective colloid 2. The aqueous solution of protective colloid 2 is agitated by a propeller 3 mounted on a rotary shaft. An aqueous solution of silver salt, an aqueous solution of halide and an aqueous solution of protective colloid are introduced into a mixer 7 provided outside the reaction vessel through addition systems 4, 5 and 6, respectively. (In this case, the aqueous solution of protective colloid may be added in the form of a mixture with the aqueous solution of halide and/or aqueous solution of silver salt.) These solutions are rapidly and strongly mixed with each other in the mixer 7. The mixture is immediately introduced into the reaction vessel 1 through a system 8.

FIG. 2 is a detailed view of the mixer 7. The mixer 7 comprises a reaction chamber 10 provided therein. In the reaction chamber 10, an agitator 9 mounted on a rotary shaft 11 is provided. An aqueous solution of silver salt, an aqueous solution of halide and an aqueous solution of protective colloid are charged into the reaction chamber 10 from two inlets 4 and 5 and another inlet (not shown). When the rotary shaft is rotated at a high speed (1,000 r.p.m. or higher, preferably 2,000 r.p.m. or higher, particularly 3,000 r.p.m.), these reaction solutions are rapidly and thoroughly mixed with each other, and the resulting solution containing extremely fine particles is immediately discharged from an outlet 8. The extremely fine particles thus formed from the reaction in the mixer can be easily dissolved in the emulsion in the reaction vessel due to its extremely fine size to become provide silver ions and halogen ions again which cause the growth of uniform grains. The halide composition of the extremely fine particles is adjusted to equal that of the desired silver halide grains. The extremely fine particles thus introduced into the reaction vessel are scattered in the reaction vessel by the agitation in the reaction vessel. At the same time, individual extremely fine particles release halogen ions and silver ions of the desired halide composition. The particles produced in the mixer are extremely fine particles generally having an average particle size of 0.001 to 0.06 μm, preferably 0.005 to 0.03 μm, more preferably 0.01 μm or less, and their number is very large. Since silver ions and halogen ions (in the case of the growth of mixed crystal, silver ions and halogen ions of the desired halogen ion composition) are released from a relatively large number of particles, and this takes place throughout the protective colloid in the reaction vessel, the growth of completely uniform grains can be achieved. It should be noted that silver ions and halogen ions must not be charged into the reaction vessel in the form of an aqueous solution except for the purpose of adjusting the pAg. It should also be noted that the protective colloid solution must not be circulated from the reaction vessel to the mixer. In this respect, the present process is quite different from the conventional process. In accordance with the present process, a surprising effect can be achieved in the uniform growth of silver halide grains.

The fine particles formed in the mixer have an extremely high solubility due to the fineness of the particle size and, when they are added to the reaction vessel, they dissolve to again form silver ion and halide ion and in turn deposit onto an extremely small number of fine particles introduced into the reaction vessel to form silver halide nuclei grains which, when stable nuclei are formed, grain growth begins. In this occasion, the larger the size of fine particles introduced into the reaction vessel, the smaller the solubility of the particles, resulting in delayed dissolution of the particles in the reaction vessel. This delayed dissolution seriously decelerates growth of the particles so much that, in some cases, the particles do not dissolve any more and effective formation of nuclei becomes impossible.

In JP-A-1-183417, this problem is resolved using the following three techniques: (i) Finely divided particles are formed in a mixer, and the resulting finely divided particles are immediately charged into a reaction vessel.

In the present invention, a mixer is provided close to the reaction vessel and the retention time of the solutions charged in the mixer is shortened. Accordingly, by immediately charging the resulting finely divided particles into the reaction vessel, Ostwald ripening can be avoided. Specifically, the retention time t of the solutions charged in the mixer can be represented by the following equation:

$$t = \frac{v}{a + b + c}$$

wherein v: volume (ml) of the reaction chamber in the mixer;

a: amount (ml/min) of the aqueous silver salt solution added;

b: amount (ml/min of the aqueous halide solution added; and c: amount (ml/min) of the protective colloid solution added In the present preparation process, t is in the range of 10 minutes or less, preferably 5 minutes or less, more preferably 1 minute or less, particularly 20 seconds or less but 2 seconds or more. Thus, the finely divided particles formed in the mixer are immediately charged into the reaction vessel without increasing their particle size.

(ii) A vigorous and efficient agitation is achieved in the mixer.

T. H. James, *The Theory of the Photographic Process*, 4th Ed., pp. 93, MacMillan 1977 states "Another type of grain growth that can occur is coalescence. In coalescence ripening, an abrupt change in size occurs when pairs or larger aggregates of crystals are formed by direct contact and welding together of crystals that were once widely separated. Both Ostwald and coalescence ripening may occur during precipitation, as well as after precipitation has stopped". Coalescence ripening as referred to herein tends to take place when the grain size is very small, particularly when the agitation is insufficient. In some extreme cases, gross lumps of grains are formed. In the present invention, a closed type mixer is used as shown in FIG. 2. Therefore, the agitator in the reaction chamber can be rotated at a high speed. Thus, a vigorous and efficient agitated mixing, which cannot be accomplished by the conventional open type reaction vessel, can be achieved. (In such an open type reaction vessel, when the agitator is rotated at a high speed, the solution is scattered by the centrifugal force. This high speed rotation also involves foaming of the material. Therefore, this high speed rotation in the open type reaction vessel is not practical.) Furthermore, the above described coalescence ripening can be prevented. As a result, finely divided particles having a relatively small particle size can be obtained. In the present invention, the number of revolutions of the agitator is 1,000 r.p.m. or more, preferably 2,000 r.p.m. or more, particularly 3,000 r.p.m. or more and not more than 10,000 r.p.m.

(iii) An aqueous solution of protective colloid is charged into a mixer.

The above described coalescence ripening can be markedly prevented by the use of a protective colloid. In the present invention, the charging of the aqueous solution of protective colloid into the mixer is accomplished in the following manner.

(a) An aqueous solution of protective colloid is singly charged into the mixer.

The concentration of the protective colloid is in the range of 0.2% by weight or more and more preferably 0.5% by weight or more. The flow rate at which the aqueous solution of protective colloid is charged into the mixer is at least 20% and not more than 300%, preferably at least 50%, more preferably 100% or more of the sum of the flow rate of the aqueous solution of silver salt and the aqueous halide solution.

(b) A protective colloid is incorporated in an aqueous halide solution.

The concentration of the protective colloid is 0.2% by weight or more and more preferably 0.5% by weight or more.

(c) A protective colloid is incorporated in an aqueous solution of silver salt.

The concentration of the protective colloid is 0.2% by weight or more and more preferably 0.5% by weight or more. If gelatin is used, gelatin silver is formed of silver ion and gelatin. The gelatin silver undergoes photolytic degradation and thermal decomposition to form silver colloid. Therefore, the silver salt solution and the protective colloid solution are preferably mixed just before use.

The above described approaches (a) to (c) may be used alone or in combination. The three methods can be used at the same time.

As the protective colloid to be used in the present invention, gelatin is usually used, but other hydrophillic colloids than gelatin may also be used. Specific descriptions thereof are given in *Research Disclosure*, Vol. 176, No. 17643 (December, 1978), Item IX.

Process (B):

As is described in JP-A-1-183644 and JP-A-1-183645, the above problem can also be solved by adding a previously prepared fine particle silver halide emulsion containing fine-sized particles to a reaction vessel and conducting nuclei formation and/or grain growth (referred to Process (B) therein). In this situation, the smaller the particle size of the previously prepared emulsion, the better the results are as described hereinbefore. In this process, too, an aqueous solution of a water-soluble silver salt and an aqueous solution of a water-soluble halide salt are not added at all except to adjust the pAg of the emulsion within the reaction vessel.

As described above, processes (A) and (B) enable formation of silver halide grains by uniform nuclei formation and/or grain growth under the condition of the absence of a silver ion or halide ion concentration gradation.

The term "completely uniform silver halide distribution" as used herein means more microscopic distribution than is meant with respect to silver halide distribution than has thus far been considered. This is explained by reference to the case of silver bromoiodide as an example. As a means for measurement of silver iodide distribution in silver bromoiodide grains, analytical electron microscopy is often employed. For example, M. A. King, M. H. Lorretto, T. J. Maternaghan and F. J. Berry "The Invention of Iodide Distribution by Analytical Electron Microscopy" in *Progress in Basic Principles of Imaging Systems*, International Congress of Photographic science, Koln (1986) discloses that, though the size of a probe for irradiating an electron beam is 50 Å, the electron beam is actually unfocused due to elastic scattering of electrons and hence the diameter of electron spot irradiated at the surface of a sample becomes as large as about 300 Å. Therefore, this technique fails to measure the silver iodide distribution of smaller order. U.K. Patents 2,110,830 and 2,109,576 also described measurement of silver iodide distribution by employing the same technique, with the size of electron beam spot used being 0.2μ.

Therefore, these measuring techniques fail to clarify the more microscopic (positional change in the order of 100 Å or less) silver iodide distribution. This microscopic distribution of silver iodide can be observed by, for example, a direct method using a transmission electron microscope at low temperatures as described in J. F. Hamilton, *Photographic Science and Engineering*, 11, 57 (1967) and Takekimi Shiozawa, *Journal of the Photographic Society of Japan*, Vol. 35, No. 4 (1972), p. 213. That is, silver halide grains removed under a safelight for preventing the emulsion grains from being printed out are placed on a mesh for observation under an electron microscope, and are observed in a transmission manner while cooling the sample with liquid nitrogen or liquid helium to prevent damage by the electron beam (e.g., print-out).

A higher acceleration voltage of the electron microscope provides a more distinct transmission image. A voltage of 200 kvolt is preferably employed for a grain thickness of up to 0.25 μm, and a voltage of 1000 kvolt for a grain thickness of more than that. Since a higher acceleration voltage leads to more damage to the grains by the electron beam, the sample is desirably cooled with liquid helium rather than by liquid nitrogen.

The photographic magnification may be varied appropriately depending upon the grain size of a particular sample, usually ranging from a 20,000 magnification to a 40,000 magnification.

Observation of the photographs of silver bromoiodide grains taken using a transmission electron microscope reveals an extremely fine growth-ring striped pattern in the silver bromoiodide phase. Intervals of the stripes are extremely small and are on the order of 100 Å or less showing extreme microscopic non-uniformity. The fact that this extremely fine striped pattern shows non-uniformity of silver iodide distribution can be demonstrated by various techniques. However, this fact can be more directly demonstrated by absolute disappearance of this striped pattern when the grains are annealed under condition such that iodide ion can migrate within the individual silver halide grains (for example, 250° C., 3 hours).

The growth-ring like striped pattern described above which shows non-uniformity of, for example, silver iodide distribution in the grains of a tabular silver bromoiodide emulsion is also clearly shown in the transmission microscope photograph attached to JP-A-58-113927. These facts reveal that conventional silver bromoiodide grains prepared with an intention of obtaining a substantially uniform silver iodide distribution have actually a non-uniform distribution of silver iodide at an extremely microscopic level contrary to the intention. Techniques have not yet been disclosed which eliminates this non-uniformity, and processes for preparing an emulsion with such uniformity have not been disclosed, either.

As has been described hereinbefore, the silver halide grains of the present invention having a "completely uniform silver iodide distribution" can be distinctly discriminated from conventional silver halide grains by viewing the transmission images of grains using a cooling-type, transmission electron microscope. That is, the silver halide grains of the present invention containing silver iodide show at most two, preferably one, more preferably no, microscopic lines at an interval of 0.2 μm originating due to microscopic non-uniformity in the silver iodide distribution. The lines constituting the growth-ring like striped pattern and showing the microscopic non-uniformity of silver iodide distribution are generated at right angles to the direction of grain growth and, as a result, these lines distribute in concentric circles with the center being the center of the grains.

Of course, when the silver iodide content is sharply changed during growth of the grains, the boundary is viewed as the same line as is described above using the above-described viewing method, but this change in silver iodide content leads to only a single line which can be distinctly discriminated from a plurality of lines due to microscopic non-uniformity of the silver iodide. In addition, the line resulting from the change in the silver iodide content can be clearly confirmed by measuring the silver iodide content on both sides of the line using the aforementioned analytical electron microscope. This line resulting from the change in silver iodide content is absolutely different from the line referred to in the present invention resulting from microscopic non-uniformity of silver iodide but rather such shows the "macroscopic silver iodide distribution". In the case where the silver iodide content during growth of the grains is substantially continuously changed, the above-described line showing the macroscopic change of silver iodide content is not viewed since a sharp change in silver iodide content is not involved. Hence, if at least three lines exist at an interval of 0.2 μm, this means that a microscopic non-uniformity of silver iodide content exists.

Thus, the silver halide grains of the present invention wherein silver iodide distribution is completely uniform are grains which show at most two lines, preferably one line, more preferably no lines, at right angles to the direction of grain growth per an interval of 0.2 μm in a transmission image thereof obtained by using a cooling-type transmission electron microscope, this indicating the presence of a microscopically non-uniform silver iodide distribution, with such grains accounting for at least 60%, preferably at least 80%, more preferably at least 90%, of the total grains.

Silver halide grains which have thus so far been referred to as uniform, silver iodide-containing silver halide grains are obtained by merely adding, upon growth of grains, silver nitrate and a halide salt mixture with a definite composition (definite iodide content) to a reaction vessel according to the double jet process. Such grains truly have a macroscopically uniform silver iodide distribution, but have a microscopically nonuniform silver iodide distribution. In the present invention, such grains are called grains with a "definite halide composition" and are distinctly different from the "completely uniform" grains of the present invention.

With silver halide mixed crystal system, microscopic uniformity of the halide distribution can further be measured by utilizing X-ray diffraction.

It is well known to those skilled in the art to determine the halide composition using an X-ray diffractometer.

The principle of X-ray diffractometry is described below.

In X-ray diffractometry, the lattice constant, a, can be determined according to the following Bragg's formula by measuring the Bragg angle:

$$2\ dhkl \sin \theta\ hkl = \lambda$$

λ: wavelength of X ray
θhkl: Bragg angle from the (hkl) face
dhkl: face-to-face distance of the (hkl) face
a: lattice constant $$dhkl = \frac{a}{\sqrt{h^2 + k^2 + l^2}}$$

T. H. James, *The Theory of the Photographic Process*, 4th Ed. (Macmillan Co., Ltd., New York), shows in Chapter 1 the relationship between halide composition and lattice constant, a, with respect to silver bromoiodide, silver chlorobromide and silver chloroiodide. When the lattice constant (halide composition) is different, the position of diffraction peak varies. Therefore, silver halide grains having an excellent uniformity in halide composition distribution and only a slightly scattered lattice constant show a narrower half-width in the diffraction profile thereof. In measurement of this diffraction profile, Kα rays are more preferably used than Kβ rays as the ray source due to large intensity and good monochromatic properties. Additionally, Kα rays are double ray, a single profile is obtained by Rachinger's method to determine the half-width. As a sample, powdery grains obtained by removing gelatin from an emulsion may be used, or a coated emulsion film may be used by dipping it in a 50% glycerin solution for 20 minutes to remove the pressure of gelatin in a dry film applied to the surfaces of grains according to the technique described in G. C. Farnell, R. J. Jenkins & L. R. Solman, *Journal of Photographic Science*, Vol. 24, p.1 (1976). In order to accurately measure the angle of diffraction profile, a technique of mixing a sample with a Si powder or NaCl powder whose diffraction angle is known is employed. Further, in order to measure the diffraction angle and the line width of the diffraction profile with good accuracy, it is known to be advantageous to use a diffraction profile showing a large diffraction angle from a higher index face. Therefore, in the present invention, the measurement is conducted on the diffraction profile of a (420) face using Kα rays as a ray source and copper as a target in the region of 71° to 77° in diffraction angle (double of Bragg's angle).

As to accuracy of X-ray diffraction measurement, a coated emulsion film sample is better than a powdery sample, and this type of measurement was conducted on coated emulsion film samples in Examples described hereinafter.

The half-width of the diffraction profile of a system free of distortion by external stress like a sample in the form described in the present specification is determined not only by the halide composition distribution but includes the half-width resulting from the optical system of the diffractometer and that resulting from the size of the crystallites of the sample. Therefore, in order to determine the half-width resulting from the halide composition distribution, it is necessary to subtract the contribution of the latter two factors. The half-width due to the optical system of the diffractometer can be determined as a half-width of the diffraction profile of single crystals of 25 μm or more free of distortion (free of dispersion of the lattice constant). Guidance of X ray diffraction by Rigaku Denki K.K., revised 2nd. ed., Chapter 2, paragraph 8 discloses that alpha-quartz of 25 to 44 μm (500-mesh on, 300-mesh under) annealed at 800° C. is used as such a sample. Si grains or a Si single crystal wafer., etc. may also be used. Since the half-width due to the optical system depends upon diffraction angle, it is necessary to determine the half-width values as to several-point diffraction profiles. The half-width due to the optical system with respect to the diffraction angle of the measuring system can be obtained by conducting, if necessary, interpolation and extrapolation. The half-width due to the size of the crystallite is described by the following formula:

$$\beta = \frac{K\lambda}{D\cos\theta} \times \frac{180}{\pi}$$

wherein $\beta$: half-width due to the size of crystallite (°)
K: constant (generally 0.9)
D: size of crystallite (Å)
λ: wavelength of X rays (Å)
$\theta$: Bragg's angle Subtraction of the thus-determined half-width due to the optical system and that due to the size of the crystallite from the half-width of the measured diffraction profile leaves a half width due to the distribution of the halide composition. The half-width due to the optical system and the half-width due to the size of crystallite as to the particular mixed crystal grains to be measured are equivalent to the half-width of the diffraction profile of the silver halide grains having the same crystal size and having a uniform halide formation distribution (lattice constant: definite). In general, where no distortion exists due to external stress, the size (edge length, diameter of a sphere having an equal volume as the grain, etc.) of grains having no lattice defect coincides with the size of crystallite. This fact is reported in F. W. Willets, *British Journal or Applied Physics.* 1965, Vol. 16, p. 323 though a photographic process and not by using a diffractometer referring to that size of AgBr crystallite determined from the width of the diffraction lines coincides with the size of the grains. In this report based on a photographic technique, the standard deviation of the profile is used instead of the half-width, selecting 1.44 as Scherrer's constant. In the inventors' measurement system where a diffractometer is used, it has been found that the size of the crystallite determined from the half-width obtained by subtracting the half-width due to the optical system determined using Si single crystals well coincides with the size of the grains with respect to AgBr grains prepared according to the balanced double jet process.

That is, the total of the half-width of mixed crystal emulsion grains due to the optical system and the half-width thereof due to the size of the crystallite can be determined as the half-width of diffraction profile of AgBr grains, AgCl grains or AgI grains of the same size as the mixed crystal emulsion grains. The half-width of the mixed crystal emulsion grains due to distribution in halide composition can be determined by subtracting the half-width of the diffraction profile of AgBr grains, AgCl grains or AgI grains of the same size as the mixed crystal emulsion grains to be measured from the measured half-width of the diffraction profile.

A preferable half-width of the X-ray diffraction measured on silver halide emulsion grains having microscopically uniform halide composition in the above-described manner is shown in FIG. 3 with respect to silver bromochloride and in FIG. 4 with respect to silver bromoiodide. In FIGS. 3 and 4, uniformity of the halide composition of the grains is presented as values calculated by subtracting the half-width of pure silver chloride or pure silver bromide grains of the same grain size, and the horizontal lines at about 0.08 in the half-width show the total of the half-width due to the optical system and the half width due to the size of the crystallite. The grains of the present invention have a half-width not more than the half-width shown by curve A, preferably not more than the half-width shown by curve B.

Silver halide grains to form a base (core portion) are preferably silver bromide series grains. The term "silver bromide series grains" as used herein means bromide ion is present in an amount of 50 mol % or more.

The silver halide grains to form a base may be any of silver bromide, silver bromoiodide, silver bromochloroiodide and silver bromochloride.

The silver halide grains to form a base may be normal crystal grains or tabular grains. The term "normal crystal grains" as used herein means single crystal grains free of twin faces. As to detailed descriptions thereon, reference may be made to T. H. James, *The Theory of the Photographic Process,* 4th ed. (Macmillan Publishing Co. Inc.), 1977, etc.

Specific shapes include cubes, octahedrons, tetradecahedrons, dodecahedrons, etc. Grains having a larger numbers of faces as shown in JP-A-62-123446, JP-A-62-123447, JP-A-62-124550, JP-A-62-124551 and JP-A-62-124552 may also be employed.

The term "tabular grains" as used herein is a general term for those grains which have one twin face or two or more parallel twin faces. In this case, a twin face means, for instance, a (111) crystal face if all ions at the lattice points are in a mirror image relationship on both sides of the (111) face. When viewed from the above standpoint, tabular grains appear to be triangular, hexagonal or their corner-round off in a circular configuration, and triangular grains have triangular external surfaces parallel to each other, hexagonal grains have hexagonal external surfaces parallel to each other, and circular grains have circular external surfaces parallel to each other.

The tabular grains to be a base and the tabular grains having highly concentrated silver chloride on the surface thereof have an average aspect ratio of 2 or more, more preferably 3 or more, most preferably 4 or more, with the upper limit being preferably 30, more preferably 20.

The size distribution of the silver halide grains for the base may be narrow or broad, but a preferable embodiment of silver halide grains is a monodisperse emulsion with a narrow size distribution (20% or less in variation coefficient).

The silver halide grains as a base, can be grains of a size of about 0.1 μm or more as a diameter of a circle having an area equal to the projected area of the grains to large-sized grains having a diameter of about 10 μm or more as a circle having an area equal to the projected area of the grain.

The interior (the so-called core portion) of the silver halide grains of the present invention may have a multilayer structure. In such cases, the layer of the surface portion of the core portion preferably possesses a completely uniform halide distribution.

The silver chloride-containing layer (the so-called shell portion) on the grain surface is deposited at high temperatures after substantial completion of the formation of the base silver halide grains. Deposition of the silver chloride-containing layer may be conducted either before or after a desalting step as long as precipitation of the base silver halide grains is substantially completed. The silver chloride-containing layer may be deposited onto the base silver halide grains before, during or after chemical ripening, too. The silver chloride-containing layer may be deposited by adding a silver salt solution and a substantially chloride solution to the base silver halide grains or by adding an emulsion substantially composed of silver chloride and ripening the mixture. It is preferable to employ a high temperature as the temperature at which the silver chloride-containing layer is deposited onto the base silver halide grains or maintain the temperature at a high level after deposition (for a time of, preferably, 5 min to 60 min). Preferably, the deposition is conducted preferably at 30° C. or above, more preferably at 35° C. or above, most preferably at 40° C. or above, with an upper limit of, preferably, 80° C. Deposition of the silver chloride-containing layer at elevated temperatures serves to deposit a stable silver chloride-containing layer free of projections on the surface of the grains instead of thermodynamically unstable epitaxial deposition. In depositing the silver chloride-containing layer at lower temperatures, it is possible to avoid epitaxial deposition by the presence of an appropriate silver halide solvent. Examples of such silver halide solvents include ammonia and potassium rhodanate, and thioethers and thione compounds as described in U.S. Pat. No. 3,271,157, JP-A-51-12360, JP-A-53-82408, JP-A-53-144319, JP-A-54-100717, JP-A-54-55828, etc. are also useful.

Even when epitaxial deposition has taken place, the objects of the present invention can be effectively attained by subsequently leaving the emulsion at higher temperatures.

The term "free of projections" as used herein means that substantially no projections, for example, by epitaxial deposition, exist on the grain surface, that is, the surface of the grains is substantially planar and is free of projections when observed using an electron microscope.

It is sufficient for the silver halide grains of the present invention to finally contain silver chloride in high concentration on the surface thereof as has been described hereinbefore. Such grains are not particularly limited in terms of the process for their preparation. However, a typical process is a process which comprises preparing the base silver halide grains, then depositing silver halide onto the surface of the grains in such a manner that the deposited silver halide has a higher silver chloride concentration. The above-described silver halide grains may easily be prepared by this process. The higher concentration of silver chloride in the surface portion specifically means a concentration higher than in the interior or the core by 1 mol % or more, preferably 3 mol % or more.

The grains having a higher concentration of silver chloride in the surface portion account for preferably 30% or more, more preferably 50% or more, most preferably 80% or more, of the total projected area of the silver halide grains in the emulsion.

The proportion of the silver chloride-containing layer deposited on the surface of the base silver halide grains is preferably 0.3 to 20 mol % based on the silver of the base grains, with 0.5 to 15 mol % being more preferable and 0.5 to 10 mol % being most preferable.

The thickness of the silver chloride-containing layer is less than 100 Å, preferably 80 Å or less, more preferably 60 Å or less, but not less than 10 Å, calculated on the assumption that the layer is deposited uniformly onto the grains.

The average thickness of the silver chloride-containing layer of the present invention deposited on the grain surface may be determined by geometric calculation based on the size, shape and amount of silver halide of the mother grain, and the amount of silver halide used for deposition but, in order to determine this more directly, a super-thin slice of a sample of silver halide grains is viewed under a transmission electron microscope as is shown in *Lecture Text for the Annual Meeting of the Photographic Society of Japan* held in 1987, pp. 46–48.

The term "silver chloride-containing layer" as used herein does not mean pure silver chloride. Since the silver chloride-containing layer undergoes a recrystallization process upon deposition onto the base silver halide grains, the halide composition of the silver chloride-containing layer depends upon the composition of the base silver halide grains. Therefore, the silver halide grains in accordance with the present invention are grains in which the silver chloride content in the surface portion of the grains is higher than that of the silver halide layer inside the surface.

The silver chloride content in the surface portion of the grains can be measured using X-ray photoelectron spectroscopy (XPS). The principle of the XPS technique is described, for example, in Junichi Aihara et al, *Electron Spectroscopy* (Kyoritsu Library 16, published by Kyoritsu Shuppan in 1978).

A standard XPS method is a technique of using Mg-Ka as exciting X rays and measuring intensity of the photoelectrons of chlorine (Cl) and silver (Ag) released from the silver halide grains in an appropriate sample form.

In order to determine the chlorine content, a calibration curve of the ratio of intensity of photoelectron from chlorine (Cl) and that from silver (Ag) (intensity (Cl)/intensity (Ag)) is prepared by using several kinds of standard samples whose chlorine contents are known, and the chlorine content of a sample can be determined from the calibration curve. With a sample of silver halide emulsion, gelatin adsorbing on the surface of silver halide grains must be removed by, for example, treatment with protease or the like before measurement of the XPS.

The grains of the present invention have a silver chloride content in the surface portion of 3 mol % or more, preferably 5 mol % or more, more preferably 7 mol % or more, measured by the XPS technique.

The average silver chloride content of the grains is up to 20 mol %, preferably up to 15 mol %, more preferably up to 10 mol %.

The average silver chloride content of the grains may be determined by, for example, the fluorescent X-ray method.

Since the silver halide grains of the present invention have a silver iodide content in the grain surface higher than that of the silver halide layer inside the surface unless the base grains are in a layered structure having a silver chloride layer therein, the silver chloride content of the grain surface measured by the XPS technique is usually higher than the average silver chloride content of the entire silver halide grains.

During formation or physical ripening of the base silver halide grains onto which the silver chloride-containing layer is to be deposited, cadmium salts, zinc salts, thallium salts, iridium salts or the complex salts thereof, rhodium salts or the complex salts thereof, iron salts or the complex salts thereof, etc. may be present.

The emulsions of the present invention are usually spectrally sensitized. Examples of suitable spectrally sensitizing dyes which and be used in the present invention include cyanine dyes, merocyanine dyes, complex cyanine dyes, complex merocyanine dyes, holopolar cyanine dyes, hemicyanine dyes, styryl dyes and hemioxonal dyes. These dyes may contain nuclei commonly used as basic heterocyclic nuclei in cyanine dyes. Namely, a pyrroline nucleius, an oxazoline nucleius, a thiazoline nucleus, a pyrrole nucleus, an oxazole nucleus, a thiazole nucleus, a selenazole nucleus, an imidazole nucleus, a tetrazole nucleus or a pyridine nucleus; nuclei wherein an alicyclic hydrocarbon ring is fused to the above-described nuclei; and nuclei wherein an aromatic hydrocarbon ring is fused to the above-described nuclei such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. can be employed. These nuclei may be substituted with substituents on the carbon atoms thereof.

The merocyanine dyes or complex merocyanie dyes may contain 5- or 6-membered heterocyclic rings such as a pyrazoline-5-one nucleus, a thiohydantoin nucleus, a 2-thioxazolidin-2,4-dione nucleus, a thiazolidin-2,4-dione nucleus, a rhodanine nucleus or a thiobarbituric acid nucleus, etc.

The amount of the sensitizing dyes to be added during preparation of silver halide emulsions cannot be described in a decisive manner but vary depending upon the kind of additive, amount of silver halide, etc., but may be the same as used in conventional processes.

That is, the sensitizing dyes can be added in amounts of preferably 0.001 to 100 mmol, more preferably 0.01 to 10 mmol, per mol of silver halide.

The sensitizing dyes are added to the emulsion before or after chemical ripening of the emulsion. With respect to the silver halide grains of the present invention, they are added most preferably before or during chemical ripening (e.g., upon formation of the grains or physical ripening).

The emulsions may contain dyes which do not have a spectral sensitization function themselves or materials which do not substantially absorb visible light but give rise to a supersensitization together with the sensitizing dyes. For example, aminostilbene compounds substituted with a nitrogen-containing heterocyclic group (such as those described in, for example, U.S. Pat. Nos. 2,933,390 and 3,635,721), aromatic organic acid-formaldehyde condensation products (for example, those described in U.S. Pat. No. 3,743,510), cadmium salts and azaindene compounds may be employed. The combinations described in U.S. Pat. Nos. 3,615,613, 3,615,641, 3,617,295 and 3,635,721 are particularly useful.

The silver halide emulsions are usually chemically sensitized. In conducting the chemical sensitization, techniques described in, for example, H. Frieser, *Die Grundlaqen der Photographishen Prozesse mit Silberhalogeniden* (Akademische Verlagsgesellschaft, 1968), pp. 675–734 may be employed.

That is, sulfur sensitization using active gelatin or sulfur-containing compounds capable of reacting with silver ion (e.g., thiosulfates, thioureas, mercapto compounds and rhodanines); reduction sensitization using reductive substances (e.g., stannous salts, amines, hydrazine derivatives, formamidinesulfinic acids and silane compounds); and noble metal sensitization using compounds of noble metals (e.g., Pt, Ir, Pd, etc. as well as gold complex salts) may be employed independently or in combination.

Various compounds for preventing fog or stabilizing the photographic properties during production, storage, or photographic processing of the light-sensitive material may be incorporated in the photographic emulsion to be used in the present invention. Namely, many compounds known as antifogging or stabilizing agents such as azoles (e.g., benzothiazolium salts, nitroindazoles, triazoles, benzotriazoles, benzimidazoles (particularly, nitro- or halogen-substituted derivatives); heterocyclic mercapto compounds (e.g., mercaptothiazoles, mercaptobenzothiazoles, mercaptobenzimidazoles, mercaptothiadiazoles, mercaptotetrazoles, particularly, 1-phenyl-5-mercaptotetrazole), mercaptopyrimidines, the above-mentioned heterocyclic mercapto compounds further including water soluble groups such as a carboxyl group and a sulfo group; thioketo compounds (e.g., oxazolinethione); azaindenes (e.g., tetraazaindenes, particularly 4-hydroxy-substituted (1,3,3a,7)-tetraazaindenes); benzenethiosulfonic acids; benzenesulfinic acids; etc. may be added.

Addition of these antifogging or stabilizing agents is usually conducted after chemical sensitization, more preferably during or before initiation of the chemical ripening. That is, the addition may be conducted during formation of the silver halide emulsion grains during addition of a silver salt solution, between addition of the solution and initiation of chemical ripening, or during chemical ripening (in the period of preferably before 50%, more preferably before 20%, of the ripening period, after initiation of the chemical ripening).

The emulsion of the present invention may be used for photographic light-sensitive materials of any layer structure regardless of whether the emulsion layer has a single layer structure or two or more multi-layers.

A silver halide multi-layer color photographic light-sensitive material using the emulsions of the present invention has a multi-layer structure wherein emulsion layers containing a binder and silver halide grains adapted for separately recording blue, green and red colors are superposed on each other, with each emulsion layer comprising at least two layers of a more sensitive layer and a less sensitive layer. Particularly practical layer structures are illustrated below:

(1) BH/BL/GH/GL/RH/RL/S;
(2) BH/BM/BL/GH/GM/GL/RH/RM/RL/S;
(3) BH/BL/GH/RH/GL/RL/S described in U.S. Pat. No. 4,184,876; and
(4) BH/GH/RH/BL/GL/RL/S described in *Research Disclosure* 22534, JP-A-59-177551, JP-A-59-177552 wherein B represents a blue-sensitive layer, G represents a green-sensitive layer, R represents a red-sensitive layer, H represents the most sensitive layer, M represents an intermediately sensitive layer, L represents a less sensitive layer, and S represents a support. The light-insensitive layers such as a protective layer, a filter layer, an interlayer, an antihalation layer, a subbing layer, etc. are not shown.

Of these, preferable layer structures are (1), (2) and (4).

In addition, (5) BH/BL/CL/GH/GL/RH/RL/S; and (6) BH/BL/GH/GL/CL/RH/RL/S etc. described in JP-A-61-34541 are also preferable layer structures.

CL as used herein represents an interimage-imparting layer, and other symbols are the same as defined above.

The order of a more sensitive layer and a less sensitive layer having the same color sensitivity may be reversed.

As has been described hereinbefore, the silver halide emulsion of this invention may be applied to color light-sensitive materials and, in addition, may be applied to other light-sensitive materials such as X-ray sensitive materials, black-and-white light-sensitive materials for photographic use, light-sensitive materials for plate making, photographic printing papers, etc. as well, regardless of whether the emulsion layer has a single layer structure or a multi-layer structure.

Various additives for the silver halide emulsion of the present invention, for example, binders, chemically sensitizing agents, spectral sensitizing agents, stabilizing agents, gelatin hardeners, surface active agents, antistatic agents, polymer latexes, matting agents, color couplers, ultraviolet light absorbents, anti-fading agents, dyes, etc. supports for light-sensitive materials using the emulsions, methods of coating the emulsion, exposing methods, development processings, and the like are not particularly limited, and reference may be made to, for example, *Research Disclosure*, Vol. 176, Item 17643 (RD-17643), ibid., Vol. 187, Item 18716 (RD-18716) and ibid., Vol. 225, Item 22534 (RD-22534).

The descriptions in these *Research Disclosure* references are tabulated in the following table.

| Kind of Additives | RD 17643 | RD 18716 | RD 22534 |
|---|---|---|---|
| 1. Chemical Sensitizers | P. 23 | P. 648, right col. | P. 24 |
| 2. Sensitivity Enhancing Agents | — | P. 648, right col. | — |
| 3. Spectrally Sensitizing Agents, and Supersensitizing Agents | PP. 23 to 24 | P. 648, right col. to p. 649, right col. | PP. 24 to 28 |
| 4. Brightening Agents | P. 24 | — | — |
| 5. Antifoggants and Stabilizers | PP. 24 to 25 | P. 649, right col. | P. 24 and p. 31 |
| 6. Light-Absorbers, Filter Dyes and Ultraviolet Light Absorbents | PP. 25 to 26 | P. 649, right col. to p. 650, left col. | — |
| 7. Stain-preventing Agents | P. 25, right col. | P. 650, left col. to right col. | — |
| 8. Dye Image Stabilizing Agents | P. 25 | — | P. 32 |
| 9. Hardeners | P. 26 | P. 651, left col. | P. 28 |
| 10. Binders | P. 26 | P. 651, left col. | — |
| 11. Plasticizers, Lubricants | P. 27 | P. 650, right col. | — |
| 12. Coating Aids, Surfactants | Pages 26 to 27 | P. 650, right col. | — |
| 13. Antistatic Agents | P. 27 | P. 650, right col. | — |
| 14. Color Couplers | P. 25 | P.649 | P. 31 |

The present invention is now illustrated in greater detail by reference to the following examples which, however, are not to be construed as limiting the present invention in any way. Unless otherwise indicated herein, all parts, percents, ratios and the like are by weight.

EXAMPLE 1

(1) Preparation of Seed Emulsion

| | | |
|---|---|---|
| Solution (A) | Bone Gelatin | 30 g |
| | Potassium Bromide | 1 |
| | 3,6-Dithiaaoctane-1,8-diol | 3.5 g |
| | Water | 1000 cc |
| Solution (B) | Silver Nitrate | 125 g |
| | Water to make | 900 cc |
| Solution (C) | Potassium Bromide | 65.6 g |
| | Potassium Iodide | 30.5 g |
| | Bone Gelatin | 15 g |
| | Water to make | 900 cc |
| Solution (D) | Bone Gelatin | 30 g |
| | Potassium Bromide | 1 g |
| | Water | 1000 cc |

Seed Emulsion 1-A:

Solution (A) was added to a reaction vessel and stirred at 75° C. Solutions (B) and (C) were added thereto according to the double-jet process over a 110 minute period.

Then, the emulsion was washed using a common flocculation process, and 30 g of gelatin was added thereto. After dissolution, the system was adjusted to a pH of 6.4 and a pAg of 8.2 at 40° C. Silver bromoiodide grains thus obtained were octahedral grains having an average grain size of 0.95 μm. This emulsion was referred to as Seed Emulsion 1-A.

Seed Emulsion 1-B:

Solution (A) was added to a reaction vessel and stirred at 75° C. Solutions (B) and (C) were added to a mixer provided in the vicinity of the reaction vessel according to the double-jet process over a 110 minute period. Residence time of the added solution within the mixer was 5 seconds, and the rate of rotation of the agitator of the mixer was 6000 r.p.m. The temperature of the mixer was kept at 33° C, and extremely fine particles (0.02 μm confirmed by a direct transmission electron microscope at 20,000×) produced in the mixer were continuously introduced into the reaction vessel. Thereafter, the emulsion was washed using a common flocculation process and, after adding thereto 30 g of gelatin to dissolve, the system was adjusted to a pH of 6.4 and a pAg of 8.2 at 40° C. The silver bromoiodide grains thus obtained were octahedral grains having an average grain size of 0.95 μm. This emulsion was referred to as Seed Emulsion 1-B.

Seed Emulsion 1-C:

Solution (D) was added to a reaction vessel and stirred at 35° C. Solutions (B) and (C) were added thereto according to the double-jet process over a 15 minute period. Then, the emulsion was washed using a common flocculation process, and 15 g of gelatin was added thereto to dissolve. Silver bromoiodide fine particles thus obtained had an average grain size of 0.05 μm.

Water was added to this emulsion to make 2250 cc, and the resulting emulsion was added to stirred Solution (A) kept at 75° C. in the reaction vessel over a 110 minute period. Thereafter, the emulsion was washed using a common flocculation process and, after adding thereto 30 g of gelatin to dissolve, the system was adjusted to a pH of 6.4 and a pAg of 8.2 at 40° C. Silver bromoiodide grains thus obtained were octahedral grains having an average grain size of 0.95 μm. This emulsion was referred to as Seed Emulsion 1-C.

X-ray Diffraction of Seed Emulsions:

Samples prepared by coating Seed Emulsions 1-A, 1 B, and 1-C, respectively, in an amount of 3.0 g of silver/$m^2$ were dipped in a 50% glycerin solution for 20 minutes, then subjected to X-ray diffractometry to determine the half-widths as described hereinbefore. As an X-ray source, Cu-Kα ray was used, and a single profile was obtained from double lines using the Rachinger's method to determine the half-widths. The half-width of pure silver bromide grains of the same size was also measured, and the seed emulsions were compared with each other in terms of the values obtained by subtracting the half-width of pure silver bromide from the half-value of each seed emulsion. The results obtained are shown in Table 1 below.

TABLE 1

| | (Half-width of Seed Emulsion) − (Half-width of Pure Silver Bromide) (°) |
|---|---|
| Seed Emulsion 1-A | 0.142 |
| Seed Emulsion 1-B | 0.036 |
| Seed Emulsion 1-C | 0.040 |

As is apparent from the results in Table 1, Seed Emulsions 1-B and 1-C possess a uniform halide composition at a microscopic level in comparison with Seed Emulsion 1-A.

(2) Preparation of Emulsion

To 800 g of Seed Emulsion 1-A (corresponding to 100 g of $AgNO_3$), water was added thereto and, stirring at 50° C., a silver nitrate aqueous solution (2 g of $AgNO_3$) and a potassium bromide aqueous solution were added according to the double-jet process while keeping the silver potential at 70 mV, followed by raising the temperature to 60° C. and maintaining at the temperature for 15 minutes. Further, the emulsion was optimally chemically sensitized with sodium thiosulfate, potassium chloroaurate and potassium thiocyanate at 65° C. to prepare Emulsion 1-a.

Emulsion 1-b:

Emulsion 1-b was prepared in the same manner as Emulsion 1-a except for adding a sodium chloride aqueous solution in place of the potassium bromide aqueous solution.

Emulsion 1-c:

Emulsion 1-c was prepared in the same manner as Emulsion 1-a except for using Seed Emulsion 1-B in place of the Seed Emulsion 1-A.

Emulsion 1-d:

Emulsion 1-d was prepared in the same manner as Emulsion 1-c except for adding a sodium chloride aqueous solution in place of the potassium bromide aqueous solution.

Emulsion 1-e:

Emulsion 1-e was prepared in the same manner as Emulsion 1-b except for using Seed Emulsion 1-C in place of the Seed Emulsion 1-A.

No projections were observed on the surfaces of monodisperse octahedral grains of 0.95 μm of projected area diameter.

(3) Preparation of Coated Samples

On a cellulose triacetate support were provided, in order from the support side, layers of the following composition to prepare a coated sample.

(Undermost Layer)

Binder: gelatin — 1 g/$m^2$

Fixing Accelerator:

E-1

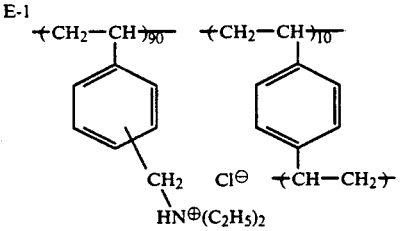

Additives for the emulsion layers other than the emulsion and surface-protective layer are shown below.

(Emulsion Layer: Emulsion 1-a, 1-b, 1-c, 1-d or 1-e)

| | |
|---|---|
| Coated Amount: | 4.0 g/$m^2$ |
| Binder: gelatin | 1.6 g/Ag 1 g |
| Sensitizing Dye: I-5 | 2.1 mg/Ag 1 g |

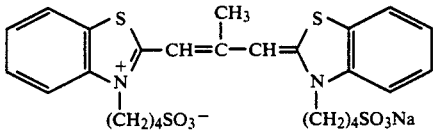

| | |
|---|---|
| Additive: $C_{18}H_{35}O-(CH_2CH_2O)_{20}-H$ | 5.8 mg/Ag 1 g |
| Coating Aid: sodium dodecylbenzenesulfonate | 0.07 mg/$m^2$ |
| Potassium Poly-p-styrenesulfonate | 0.7 g/$m^2$ |
| (Surface-Protective Layer) | |
| Binder: gelatin | 0.7 g/$m^2$ |
| Coating Aid: sodium N-oleoyl-N-methyl taurine | 0.2 mg/$m^2$ |
| Matting Agent: polymethylmethacrylate particles (average particle size 3 μm) | 0.13 mg/$m^2$ |

(4) Sensitometry

These samples were stored at 25° C. and 65% RH for days after coating. Further, these samples were exposed for 1 second through a continuous wedge using a tungsten lamp (color temperature: 2854° K), then developed in the following developer at 20° C. for 7 minutes, fixed with a fixing solution (Fuji Fix; made by Fuji Photo Film Co., Ltd.), washed with water and dried. The sensitivities of the thus obtained emulsions are presented as relative values of the reciprocals of the exposure amounts required for obtaining an optical density of fog+0.1.

| Developer: | |
|---|---|
| Metol | 2 g |
| Anhydrous Sodium Sulfite | 100 g |
| Hydroquinone | 5 g |
| Borax | 1.53 g |
| Water to make | 1000 ml |

(5) Measurement of Graininess

Graininess was evaluated in terms of RMS graininess measured with a 48-μ aperture diameter (at a portion of 0.5 in optical density). RMS graininess is described in T. H. James, *The Theory of the Photographic Process* (1977, Macmillan), pp. 619–620.

The results thus obtained are tabulated in Table 2 below.

TABLE 2

| | Characteristics of Grains | Relative Sensitivity | RMS Graininess | Notes |
|---|---|---|---|---|
| Emulsion 1-a | Seed Emulsion 1-A, free of surface AgCl layer | 100 (standard) | 0.018 | (comparative example |
| Emulsion 1-b | Seed Emulsion 1-A, with surface AgCl layer | 120 | 0.018 | (comparative example) |
| Emulsion 1-c | Seed Emulsion 1-B, free of surface AgCl layer | 115 | 0.018 | (comparative example |
| Emulsion 1-d | Seed Emulsion 1-B, with surface AgCl layer | 115 | 0.018 | (present invention) |
| Emulsion 1-e | Seed Emulsion 1-C, with surface AgCl layer | 168 | 0.018 | (present invention) |

As is apparent from the results in Table 2, the emulsions using the grains of the present invention possess higher sensitivity than conventional emulsions while graininess is equal.

EXAMPLE 2

Multi-layer color light-sensitive materials each comprising a subbed cellulose triacetate film support having provided thereon layers of the following composition were prepared using Emulsions 1-b, 1-c and 1-d prepared as in EXAMPLE 1.

Composition of Light-Sensitive Layer

Coated amounts are presented in terms of g/m$^2$ of silver with respect to silver halide and colloidal silver, g/m$^2$ with respect to couplers, additives and gelatin, and mol number per mol of silver halide in the same layer with respect to sensitizing dyes.

| | |
|---|---|
| First Layer: Antihalation Layer | |
| Black Colloidal Silver | 0.2 |
| Gelatin | 1.3 |
| Colored Coupler C-1 | 0.06 |
| UV Light Absorbent UV-1 | 0.1 |
| UV Light Absorbent UV-2 | 0.2 |
| Dispersing Oil Oil-1 | 0.01 |
| Dispersing Oil Oil-2 | 0.01 |
| Second Layer: Interlayer | |
| Fine Grain Silver Bromide (average grain size: 0.07μ) | 0.15 |
| Gelatin | 1.0 |
| Color Coupler C-2 | 0.02 |
| Dispersing Oil Oil-1 | 0.1 |
| Third Layer: First Red-Sensitive Emulsion Layer | |

-continued

| | |
|---|---|
| Silver Bromoiodide Emulsion (AgI: 2 mol %, average grain size: 0.3μ) | 0.4 g of silver |
| Gelatin | 0.6 |
| Sensitizing Dye I | $1.0 \times 10^{-4}$ |
| Sensitizing Dye II | $3.0 \times 10^{-4}$ |
| Sensitizing Dye III | $1.0 \times 10^{-5}$ |
| Coupler C-3 | 0.06 |
| Coupler C-4 | 0.06 |
| Coupler C-8 | 0.04 |
| Coupler C-2 | 0.03 |
| Dispersing Oil Oil-1 | 0.03 |
| Dispersing Oil Oil-3 | 0.012 |
| Fourth Layer: Second Red-Sensitive Emulsion Layer | |
| Silver Bromoiodide Emulsion (AgI: 5 mol %, average grain size: 0.5μ) | 0.7 |
| Sensitizing Dye I | $1.0 \times 10^{-4}$ |
| Sensitizing Dye II | $3.0 \times 10^{-4}$ |
| Sensitizing Dye III | $1.0 \times 10^{-5}$ |
| Coupler C-3 | 0.24 |
| Coupler C-4 | 0.24 |
| Coupler C-8 | 0.04 |
| Coupler C-2 | 0.04 |
| Dispersing Oil Oil-1 | 0.15 |
| Dispersing Oil Oil-3 | 0.02 |
| Fifth Layer: Third Red-Sensitive Emulsion Layer | |
| Emulsion-Emulsion 1-b or Emulsion 1-c or Emulsion 1-d | 1.0 of silver |
| Gelatin | 1.0 |
| Sensitizing Dye I | $1.0 \times 10^{-4}$ |
| Sensitizing Dye II | $3.0 \times 10^{-4}$ |
| Sensitizing Dye III | $1.0 \times 10^{-5}$ |
| Coupler C-6 | 0.05 |
| Coupler C-7 | 0.1 |
| Dispersing Oil Oil-1 | 0.01 |
| Dispersing Oil Oil-2 | 0.05 |
| Sixth Layer: Interlayer | |
| Gelatin | 1.0 |
| Compound Cpd-A | 0.03 |
| Dispersing Oil Oil-1 | 0.05 |
| Seventh Layer: First Green-Sensitive Emulsion Layer | |
| Silver Bromoiodide Emulsion (AgI: 4 mol %, average grain size: 0.3μ) | 0.30 g |
| Sensitizing Dye IV | $5.0 \times 10^{-4}$ |
| Sensitizing Dye VI | $0.3 \times 10^{-4}$ |
| Sensitizing Dye V | $2.0 \times 10^{-4}$ |
| Gelatin | 1.0 |
| Coupler C-9 | 0.2 |
| Coupler C-5 | 0.03 |
| Coupler C-1 | 0.03 |
| Dispersing Oil Oil-1 | 0.5 |
| Eighth Layer: Second Green-Sensitive Emulsion Layer | |
| Silver Bromoiodide Emulsion (AgI: 4 mol %, average grain size: 0.5μ) | 0.4 g |
| Sensitizing Dye IV | $5.0 \times 10^{-4}$ |
| Sensitizing Dye V | $2.0 \times 10^{-4}$ |
| Sensitizing Dye VI | $0.3 \times 10^{-4}$ |
| Coupler C-9 | 0.25 |
| Coupler C-1 | 0.03 |
| Coupler C-10 | 0.015 |
| Coupler C-5 | 0.01 |
| Dispersing Oil Oil-1 | 0.2 |
| Ninth Layer: Third Green-Sensitive Emulsion Layer | |
| Emulsion-Emulsion 1-b or Emulsion 1-c or Emulsion 1-d | 0.85 of silver |
| Gelatin | 1.0 |
| Sensitizing Dye VII | $3.5 \times 10^{-4}$ |
| Sensitizing Dye VIII | $1.4 \times 10^{-4}$ |
| Coupler C-11 | 0.01 |
| Coupler C-12 | 0.03 |
| Coupler C-13 | 0.20 |
| Coupler C-1 | 0.02 |
| Coupler C-15 | 0.02 |
| Dispersing Oil Oil-1 | 0.20 |
| Dispersing Oil Oil-2 | 0.05 |
| Tenth Layer: Yellow Filter Layer | |
| Gelatin | 1.2 |
| Yellow Colloidal Silver | 0.08 |
| Compound Cpd-B | 0.1 |
| Dispersing Oil Oil-1 | 0.3 |

-continued

| | |
|---|---|
| Eleventh Layer: First Blue-Sensitive Layer | |
| Mono-Disperse Silver Bromoiodide Emulsion (AgI: 4 mol %; average grain size: 0.3μ) | 0.4 of silver |
| gelatin | 1.0 |
| Sensitizing Dye IX | $2.0 \times 10^{-4}$ |
| Coupler C-14 | 0.9 |
| Coupler C-5 | 0.07 |
| Dispersing Oil Oil-1 | 0.2 |
| Twelfth Layer: Second Blue-Sensitive Emulsion Layer | |
| Emulsion-Emulsion 1-b or Emulsion 1-c or Emulsion 1-d | 0.5 of silver |
| Gelatin | 0.6 |
| Sensitizing Dye IX | $1.0 \times 10^{-4}$ |
| Coupler C-14 | 0.25 |
| Dispersing Oil Oil-2 | 0.07 |
| Thirteenth Layer: First Protective Layer | |
| Gelatin | 0.8 |
| UV Light Absorbent UV-1 | 0.1 |

-continued

| | |
|---|---|
| UV Light Absorbent UV-2 | 0.2 |
| Dispersing Oil Oil-1 | 0.01 |
| Dispersing Oil Oil-2 | 0.01 |
| Fourteenth Layer: Second Protective Layer | |
| Fine Grain Silver Bromide (average grain size: 0.07μ) | 0.5 |
| Gelatin | 0.45 |
| Polymethyl Methacrylate Particles (diameter: 1.5μ) | 0.2 |
| Hardener H-1 | |
| Formaldehyde Scavenger S-1 | 0.5 |
| Formaldehyde Scavenger S-2 | 0.5 |

A surfactant was added as a coating aid to each of the above-described layers in addition to the above-described ingredients.

The chemical structural formulae or chemical names of the component are shown below.

UV-1

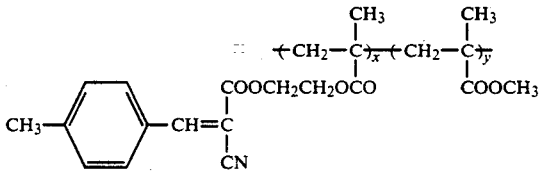

X/Y = 7/3 (by weight)

UV-2

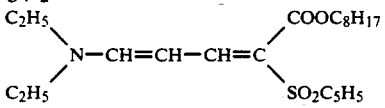

Oil-1: Tricresyl phosphate

Oil-2: Dibutyl phthalate

Oil-3: Bis(2-ethylhexyl) phthalate

C-1

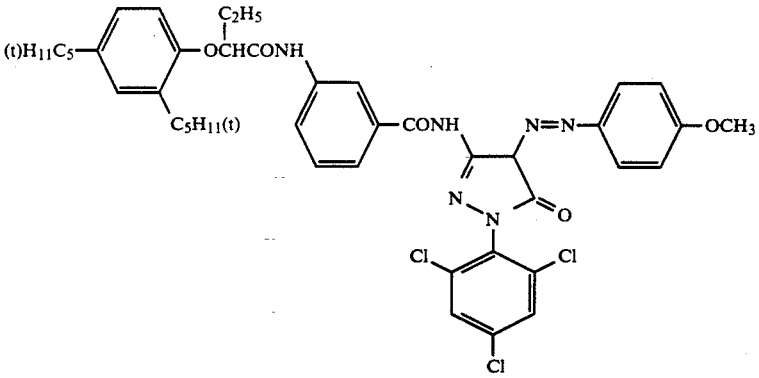

C-2

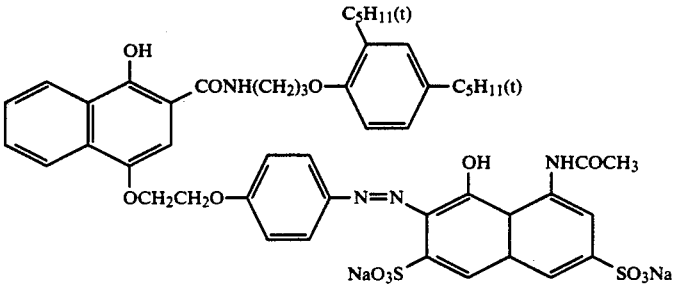

-continued
C-3
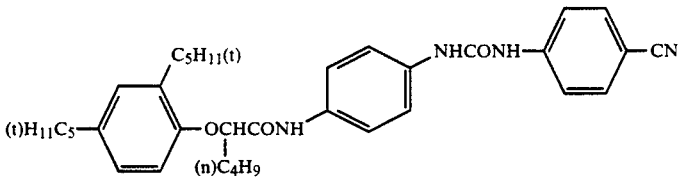
C-4
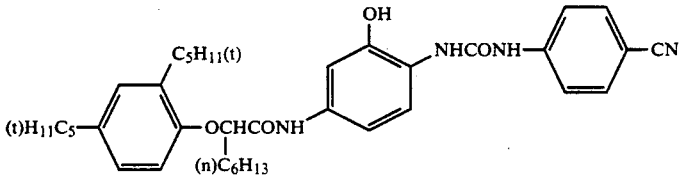
C-5
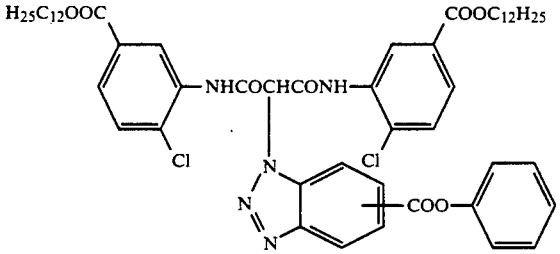
C-6
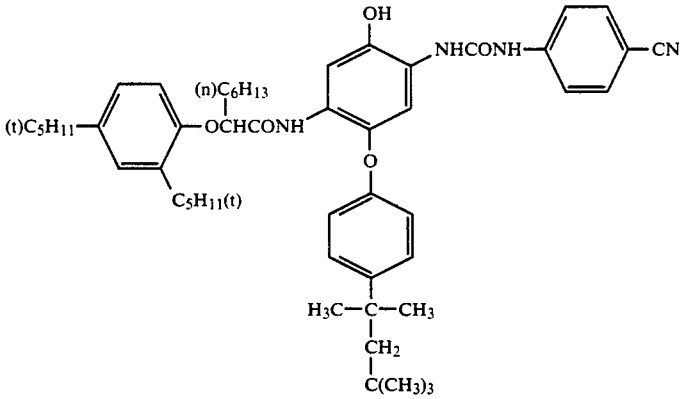
C-7
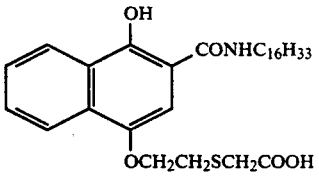
C-8
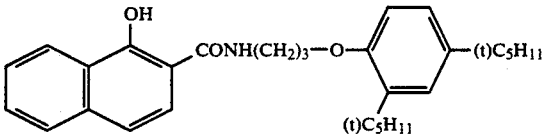
C-9

-continued
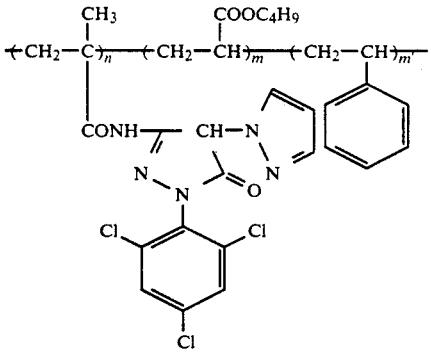
n = 50
m = 25
m' = 25
mol.wt. ca 20,000
C-10
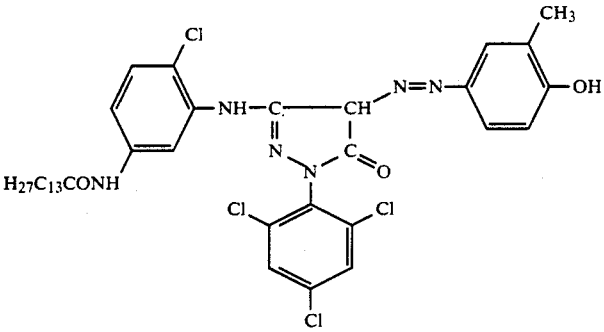
C-11
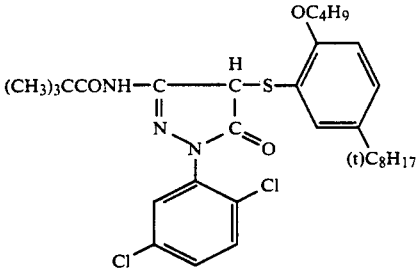
C-12
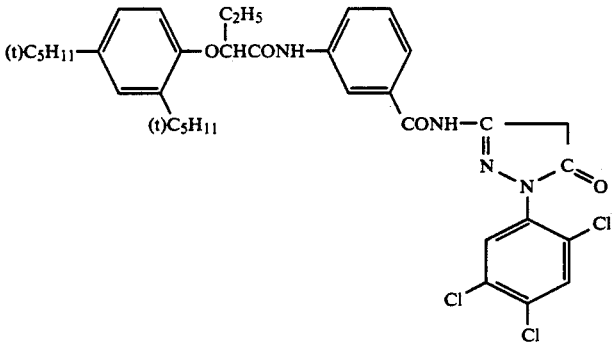
C-13

-continued
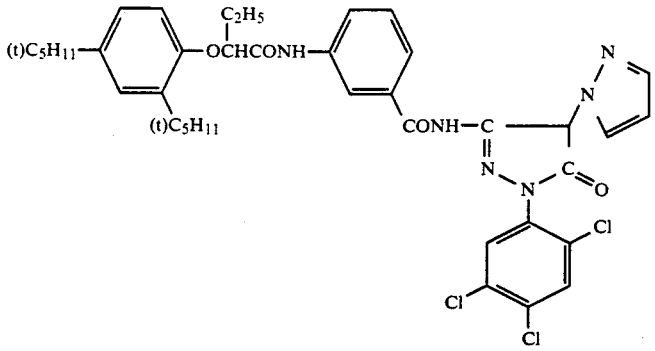
C-14
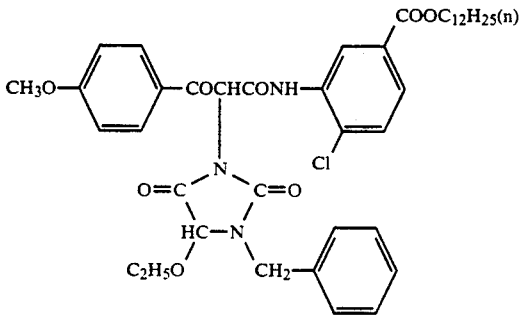
C-15
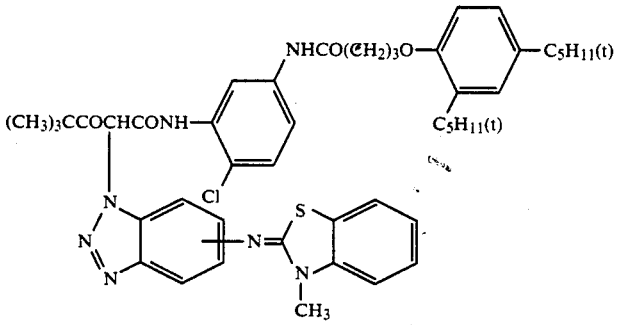
CpdA
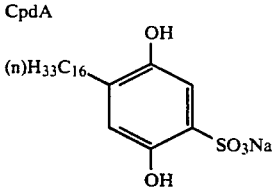
CpdB
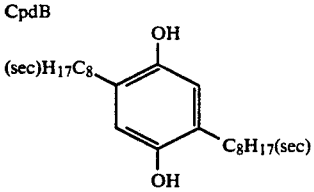
Sensitizing Dye I
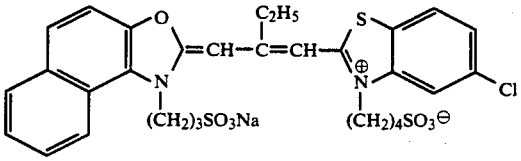
Sensitizing Dye II -continued
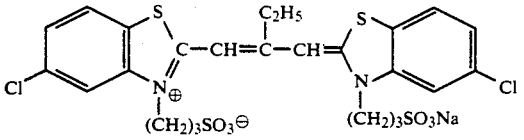
Sensitizing Dye III
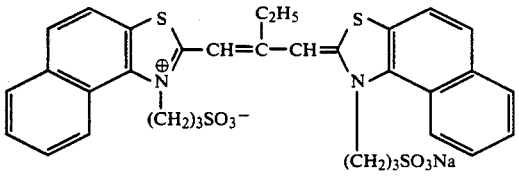
Sensitizing Dye IV
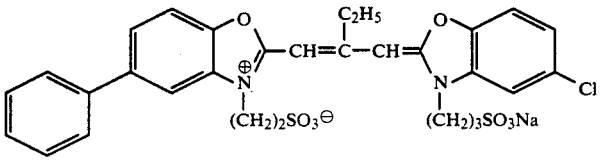
Sensitizing Dye V
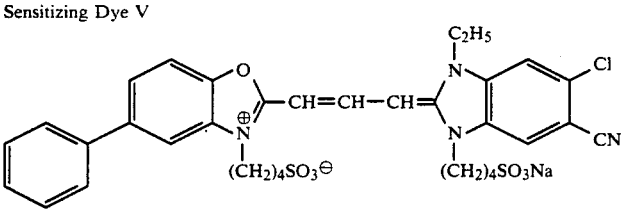
Sensitizing Dye VI
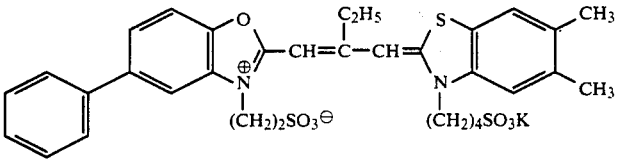
Sensitizing Dye VII
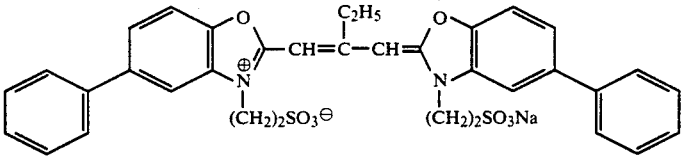
Sensitizing Dye VIII
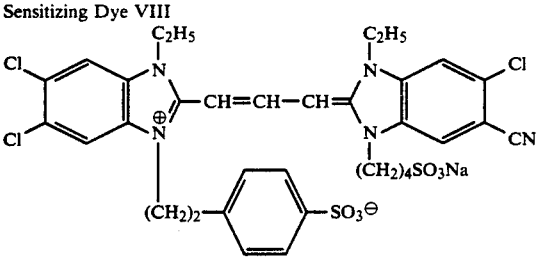
Sensitizing Dye IX
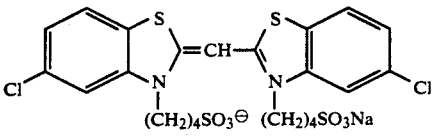

-continued $CH_2{=}CH{-}SO_2{-}CH_2{-}CONH{-}CH_2$
$CH_2{=}CH{-}SO_2{-}CH_2{-}CONH{-}CH_2$

S-1

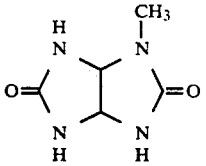

S-2

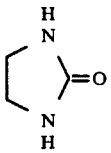

This photographic element was exposed in an amount of 25 CMS using a tungsten light source with adjustment of the color temperature to 4800° K, then subjected to development processing according to the following processing steps at 38° C.

| | |
|---|---|
| Color development | 3 min & 15 sec |
| Bleaching | 6 min & 30 sec |
| Washing with Water | 2 min & 10 sec |
| Fixing | 4 min & 20 sec |
| Washing with Water | 3 min & 15 sec |
| Stabilizing | 1 min & 05 sec |

The compositions of the processing solutions used in respective steps were as follows:

| | |
|---|---|
| Color Developer: | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-Ethyl-N-β-hydroxyethylamino)-2-methyl-aniline Sulfate | 4.5 g |
| Water to make | 1 l |
| Bleaching Solution: | |
| Ammonium Bromide | 160.0 g |
| Aqueous Ammonia (28 wt %) | 25.0 ml |
| Sodium Iron Ethylenediaminetetra-acetate | 130 g |
| Glacial Acetic Acid | 14 ml |
| Water to make | 1 l |
| Fixing Solution: | |
| Sodium Tetrapolyphosphate | 2.0 g |
| Sodium sulfite | 4.0 g |
| Ammonium Thiosulfate (70 wt % aqueous solution) | 175.0 ml |
| Sodium Bisulfite | 4.6 g |
| Water to make | 1 l |
| Fixing Solution: | |
| Formaldehyde (3 wt % aqueous solution) | 8.0 ml |
| Water to make | 1 l |

The sensitivities of the thus obtained emulsions are presented as relative values of reciprocals of exposure amounts required for obtaining an optical density of fog+0.2.

RMS graininess was measured in the same manner as in EXAMPLE 1.

The results thus obtained are tabulated in Table 3 below.

TABLE 3

| | Characteristics of Grains | Relative Sensitivity | RMS Graininess | Notes |
|---|---|---|---|---|
| Emulsion 1-b | Seed Emulsion 1-A, with surface AgCl layer | 100 (standard) | 0.023 | (comparative example |
| Emulsion 1-c | Seed Emulsion 1-B, free of surface AgCl layer | 98 | 0.023 | (comparative example |
| Emulsion 1-d | Seed Emulsion 1-B, with surface AgCl layer | 143 | 0.023 | (present invention) |

A is apparent from the results in Table 3, the emulsions using the grains of the present invention possess higher sensitivity than conventional emulsions while the graininess is equal.

While the invention has been described in detail and with reference to specific embodiments thereof, it will be apparent to one skilled in the art that various changes and modifications can be made therein without departing from the spirit and scope of the present invention.

What is claimed is:

1. A process for producing a silver halide photographic emulsion containing light-sensitive silver halide grains having a structure comprising cores completely uniform in halide distribution and shells with a higher silver chloride content than the cores deposited outside the cores with no projections, wherein said cores are composed of AgBrI, AgBrClI, or AgClBr, comprising (1) mixing an aqueous solution of a water-soluble silver salt and an aqueous solution of a water-soluble halide salt to prepare a silver halide emulsion containing fine-size silver halide particles, wherein an aqueous solution of a protective colloid is charged at a concentration of at least 0.2% by weight in at least one of the following ways:

(a) singly in the reaction system;

(b) in the aqueous solution of the water-soluble silver salt; and (c) in the aqueous solution of the water-soluble halide salt; and (2) forming the cores in a reaction vessel using the previously prepared silver halide emulsion containing fine-size silver halide particles;

wherein said cores show at most two lines at a right angle to the direction of grain growth at an interval of 0.2 μm in a transmission electron microscope image of the grain; wherein the fine grains have a particle size of 0.001 to 0.06 μm; and wherein, silver ion and halogen ion are not added into the reaction vessel during the formation of the core, and a protective colloid solution is not circulated from the reaction vessel to a mixer.

2. A process for producing a silver halide emulsion as in claim 1, wherein said process comprises supplying an aqueous solution of a water-soluble silver salt and an aqueous solution of a water-soluble halide salt into a mixer provided outside the reaction vessel, and mixing the solutions in the mixer to form silver halide fine particles, immediately feeding the fine particles to the reaction vessel, conducting nuclei formation and/or crystal growth to prepare silver halide grains, then depositing silver halide with a higher silver chloride content than the above-prepared silver halide grains as cores on the outside of the cores with no projections formed.

3. A process for producing a silver halide photographic emulsion as in claim 1, wherein said cores account for at least 60% of the total projected area of said grains.

4. A process for producing a silver halide photographic emulsion as in claim 1, wherein said cores contain at least 50 mol % of silver bromide.

5. A process for producing a silver halide photographic emulsion as in claim 1, wherein said shells contain at least 1 mol % more silver chloride than the mol % of silver chloride in said cores.

6. A process for producing a silver halide photographic emulsion as in claim 1, wherein the amount of silver in said shells is from 0.3 to 20 mol % based on the amount of silver in said cores.

7. A process for producing a silver halide photographic emulsion as in claim 1, wherein the thickness of said shells is from 10 Å to less than 100 Å.

8. A process for producing a silver halide photographic emulsion as in claim 1, wherein said light sensitive silver halide grains contain as a whole 20 mol % or less of silver chloride and said shells contain at least 3 mol % of silver chloride.

9. A process for producing a silver halide photographic emulsion as in claim 1, wherein said cores are silver bromochloride and have an X-ray diffraction half-width falling within the range between curve A of FIG. 3 and the total half-width due to the optical system and the half-width due to the size of the crystallite.

10. A process for producing a silver halide photographic emulsion as in claim 1, wherein said cores are silver bromoiodide and have an X-ray diffraction half-width falling without the range between curve A of FIG. 4 and the total half-width due to the optical system and the half-width due to the size of the crystallite.

* * * * *